US012336649B1

(12) United States Patent
Sarno

(10) Patent No.: US 12,336,649 B1
(45) Date of Patent: Jun. 24, 2025

(54) PLANT CADDY WITH THERMOPLASTIC OVER-MOLDING AND METHOD OF MANUFACTURING THE SAME

(71) Applicant: Magic Plastics, Inc., Valencia, CA (US)

(72) Inventor: Anna Sarno, Valencia, CA (US)

(73) Assignee: Magic Plastics, Inc., Valencia, CA (US)

( * ) Notice: Subject to any disclaimer, the term of this patent is extended or adjusted under 35 U.S.C. 154(b) by 0 days.

(21) Appl. No.: 18/412,825

(22) Filed: Jan. 15, 2024

(51) Int. Cl.
*A47G 7/04* (2006.01)

(52) U.S. Cl.
CPC ..... *A47G 7/041* (2013.01); *A47G 2400/10* (2013.01)

(58) Field of Classification Search
None
See application file for complete search history.

(56) References Cited

U.S. PATENT DOCUMENTS 5,819,469 A * 10/1998 Hsu ..... A47G 7/041 47/71
7,114,288 B1 * 10/2006 Kershaw ..... A47G 7/041 47/39
2023/0052331 A1 * 2/2023 Hung ..... F16M 11/42

* cited by examiner

*Primary Examiner* — Yung-Sheng M Tsui
(74) *Attorney, Agent, or Firm* — James M. Duncan; Scanlon Duncan LLP

(57) ABSTRACT

The present invention relates to a plant caddy comprising a first molded thermoplastic member having a top planar surface and a bottom surface. The bottom surface includes a plurality of downward facing wheel pedestals. The first molded thermoplastic member also includes a plurality of pocket members, each having an upper section set within the top planar surface and a lower section set within the bottom surface. Each pocket member has at least one aperture allowing a flow of thermoplastic material between the upper and lower sections. The plant caddy further includes a plurality of thermoplastic over-mold members, with each over-mold member having a first portion disposed within the upper section of a dedicated pocket and a second portion disposed within the lower section of the dedicated pocket. Additionally, the plant caddy includes a plurality of wheel members, each attached to a dedicated downward facing wheel pedestal.

20 Claims, 5 Drawing Sheets

PLANT CADDY WITH THERMOPLASTIC OVER-MOLDING AND METHOD OF MANUFACTURING THE SAME

The present invention generally relates to wheeled platforms utilized for displaying and transporting heavy items. The present invention more specifically relates to a wheeled platform or plant caddy for the positioning of a potted plant.

Potted plants provide an attractive feature for decorating a home, patio, business, etc. However, when it is desired to move the potted plant, the operation may be difficult because of the weight and/or bulkiness of the potted plant. The pot or container holding the plant may hold a substantial volume of soil, making the potted plant quite heavy and difficult to move. Even artificial plants, because of the size, may be bulky and therefore difficult to move.

While it is known to utilize wheeled platforms as plant caddies for potted plants, with many of these devices the bottom of the plant container rests flat across the top surface of the caddie, making it difficult to obtain a fingerhold beneath the plant container if necessary for repositioning the plant container on the plant caddy or, if necessary, to lift the plant container off of the plant caddy.

Some plant caddies do not provide for water drainage from the plant container, resulting in either water retention within the plant container or in water pooling on the top surface of the plant caddy. Depending of the type of plant container, drainage from the plant container may be inhibited by drain holes in the plant container being blocking by the top surface of the plant caddy.

In addition, many plant caddies utilize different materials, such as wood or metal, to improve the durability and aesthetics of the device. However, these materials can be heavy and expensive, making the devices less portable and affordable for consumers. Furthermore, the manufacturing processes for these materials may involve additional steps increasing production time and expense. a device which provides ease of use and which is relatively inexpensive to manufacture is desirable.

SUMMARY OF THE INVENTION

Embodiments of the present invention provide an answer to the above-identified need. Overmolding is the process of melting and injecting a thermoplastic elastomer (TPE) onto a pre-existing rigid plastic part or substrate. The process creates both a chemical bond and a mechanical bond between the TPE and the rigid plastic part. A variety of materials can be used in this process, including ABS (acrylonitrile butadiene styrene, HDPE (high-density polyethylene), PA (Nylon), PP (Polypropylene), for the Substrate, and a specific TPE (Thermoplastic Elastomer), or TPR (Thermoplastic Rubber) for the overmold. With the use of these types of materials, a chemical bond is formed between the substrate and the over-mold portions. It is to be appreciated that many materials can be used for the substrate, including metal, but a chemical bond may not be achieved between the substrate and over-mold portions.

In some aspects, the embodiments and processes described herein relate to a plant caddy including a first molded thermoplastic member having a top planar surface and a bottom surface, wherein the bottom surface includes a plurality of downward facing wheel pedestals. The first molded thermoplastic member further includes a plurality of pocket members, each of the pocket members including an upper section set within the top planar surface and a lower section set within the bottom surface. Each of the pocket members further includes at least one aperture extending between the upper section and the lower section. Each of the apertures is configured to allow a flow of a thermoplastic material between the upper section and the lower section. Embodiments of the plant caddy further comprises a plurality of thermoplastic over-mold members, each of the thermoplastic over-mold members having a first portion disposed within the upper section of a dedicated pocket and a second portion disposed within the lower section of the dedicated pocket. The embodiments of the disclosed plant caddy further comprise a plurality of wheel members, each wheel member attached to a dedicated downward facing wheel pedestal of the first molded thermoplastic member.

In some aspects, the techniques described herein relate to a method of manufacturing a plant caddy including the following steps: forming through a molding process a first thermoplastic member, the first thermoplastic member having a top planar surface and a bottom surface, wherein the bottom surface includes a plurality of downward facing wheel pedestals, the platform including a plurality of pocket members, each of the pocket members including at least one aperture extending between the top planar surface and the bottom surface; allowing the first thermoplastic member to cool; applying a heated thermoplastic resin to the first thermoplastic member, the heated thermoplastic resin filling each of the plurality of pocket members and flowing through the apertures of each pocket member resulting in a first portion of the heated thermoplastic resin on the top planar surface and a second portion of the second heated thermoplastic resin on the bottom planar surface; allowing the second heated thermoplastic resin to cool to a solid resulting in a plurality of thermoplastic over-mold members, each disposed within a pocket member, the thermoplastic over-mold members bonded with the first thermoplastic member; and affixing a wheel to each of the downward facing wheel pedestals.

The first portion of the over-mold members may have a top surface which extends above the top planar surface. In this embodiment, a plant container will rest on the top surface of the first portion of the over-mold members thereby leaving gaps between the bottom surface of the plant container and the top planar surface of the plant caddy. These gaps allow a person to obtain a fingerhold beneath the plant container. In addition, these gaps allow water dripping from the bottom of the plant container to flow to either the sides of the plant caddy or flow to a center opening in the plant caddy thereby allowing water to flow out of the plant container and off of the plant caddy. In addition, the top surface of the over-mold members being soft, provide a surface which prevents the plant container from sliding off the caddy when the plant container is pushed to move the plant with the plant caddy.

In some aspects, the techniques described herein relate to a plant caddy including: a first molded thermoplastic member including a circular platform including a top planar surface and a bottom surface, wherein the circular platform is bounded by a circumferential edge member, wherein the first molded thermoplastic member further includes a circular opening concentric with the circumferential edge member, the circular opening extending through the top planar surface to the bottom surface, wherein the bottom surface includes a plurality of downward facing wheel pedestals, with each downward facing wheel pedestal having a wheel member attached to it.

The first molded thermoplastic member may further include a plurality of pocket members, each of the pocket members including an upper section set within the top planar surface and a lower section set within the bottom surface; a plurality of thermoplastic over-mold members, each of said thermoplastic over-mold members having a first portion disposed within the upper section of a dedicated pocket member and a second portion disposed within the lower section of the dedicated pocket member, wherein each of the first portions has a top surface which extends above the top planar surface. As described above, this configuration provides a plant caddy which provides for a plant container resting on the top surface of the first portion of the over-mold members thereby leaving gaps between the bottom surface of the plant container and the top planar surface of the plant caddy allowing a person to obtain a fingerhold beneath the plant container. Water exiting through openings in the bottom of the plant container may flow through the gaps between the top portion of the over-mold members and the top planar surface of the circular platform to exit through the circular opening.

DETAILED DESCRIPTION OF THE INVENTION

Figure 1:
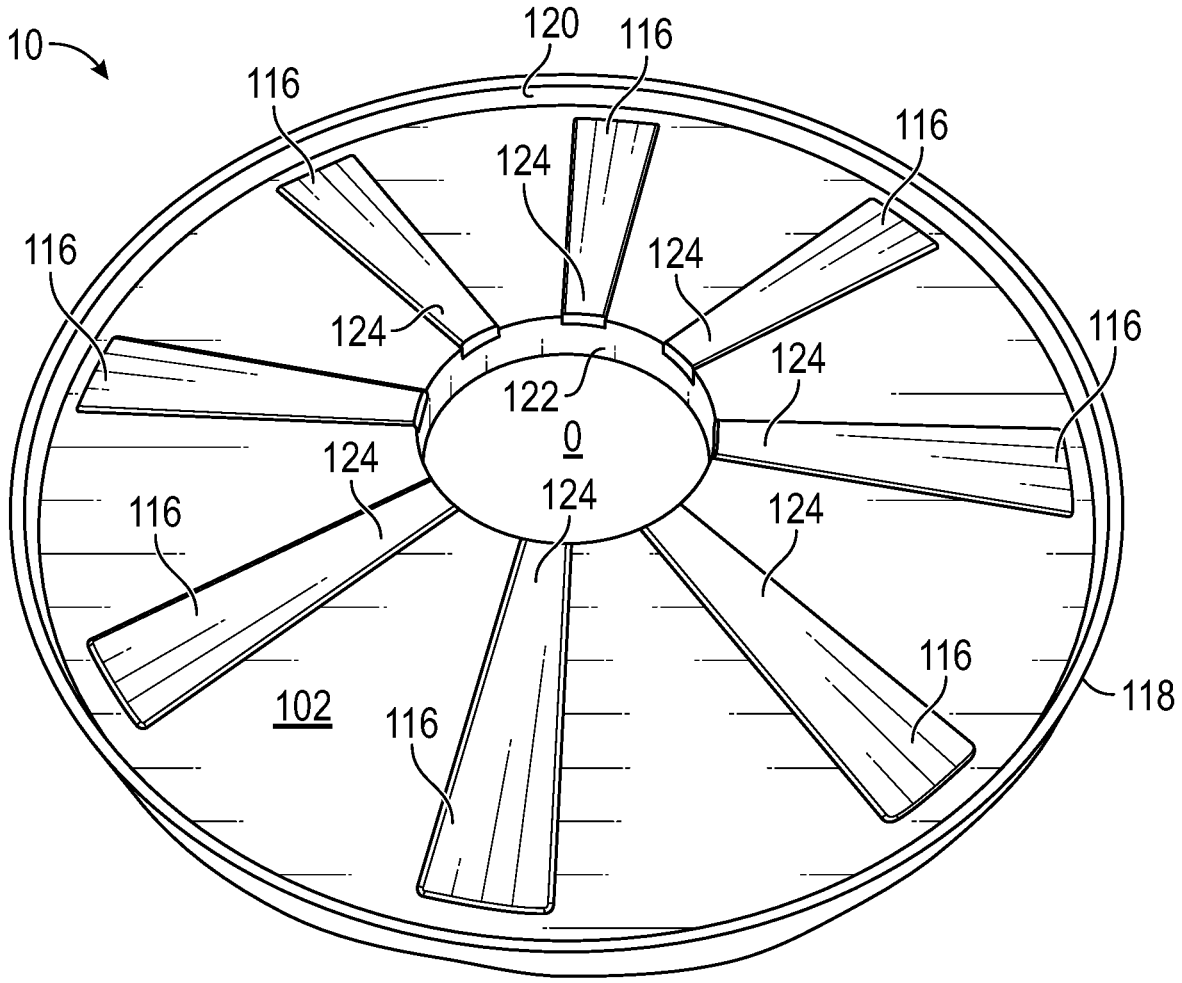
FIG. 1 shows a top perspective view of an embodiment of the disclosed plant caddy.
Figure 4:
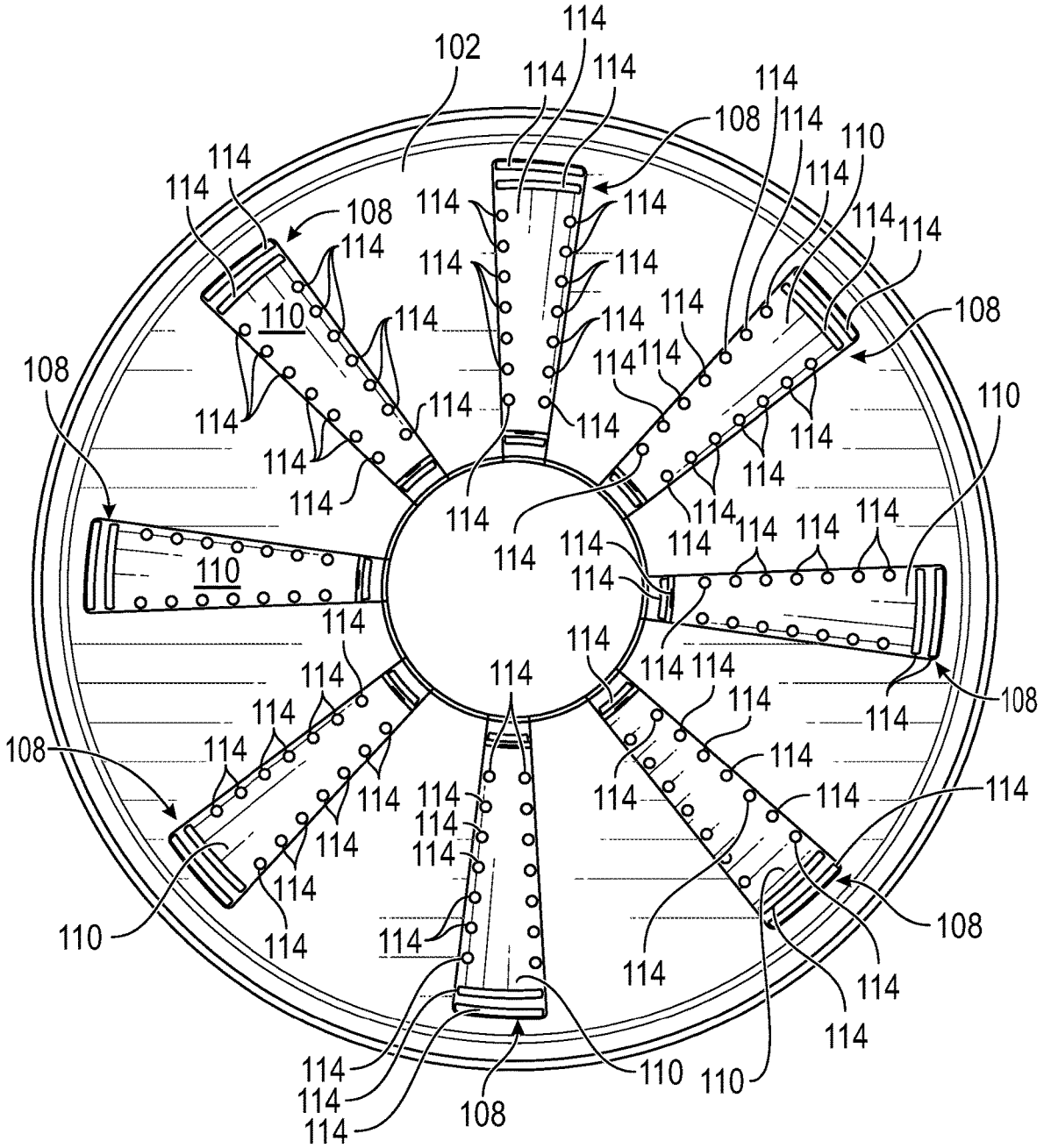
FIG. 4 shows a top view of an embodiment of the first molded thermoplastic member which may be utilized to form an embodiment of the disclosed plant caddy.
Figure 5:
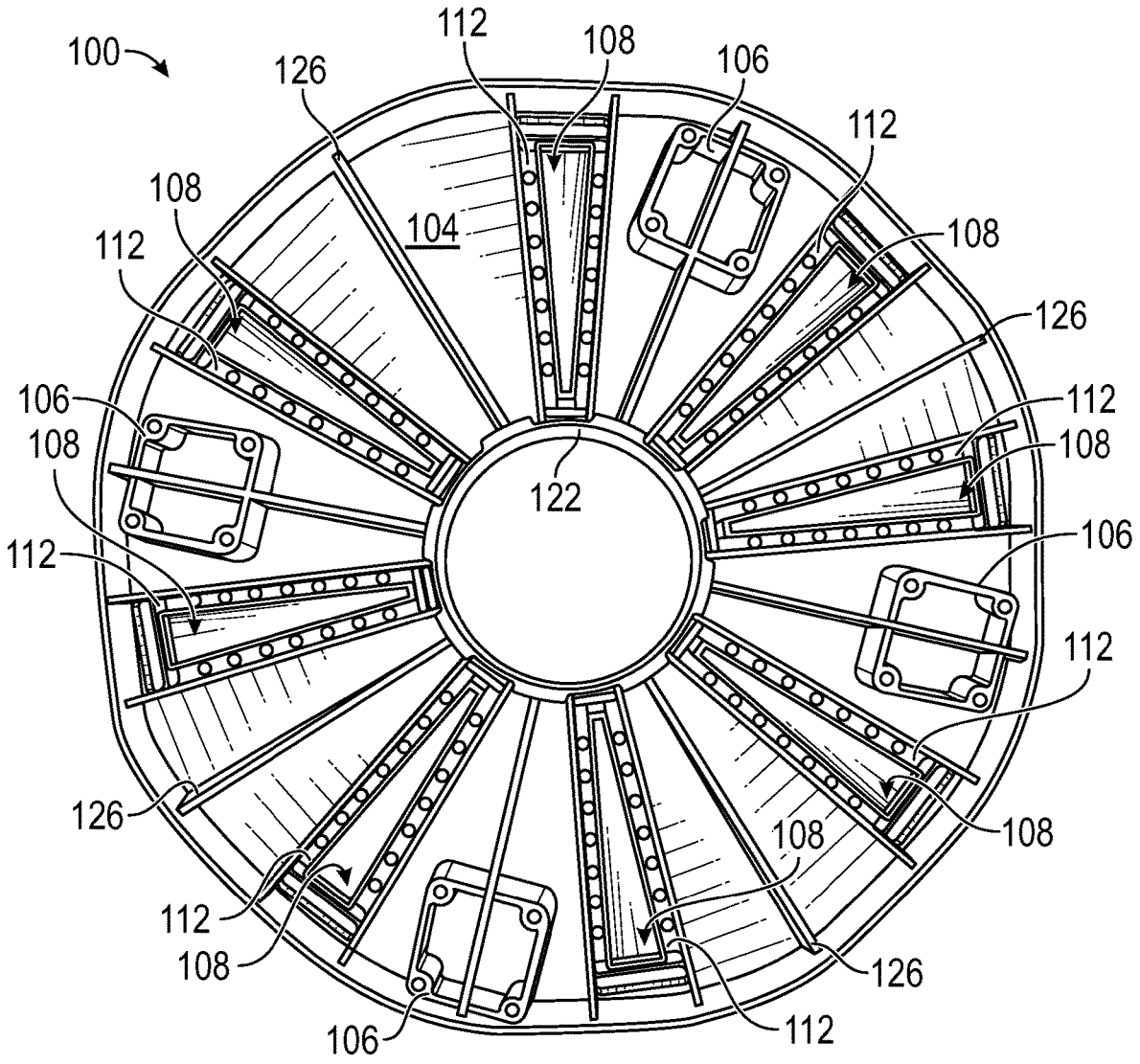
FIG. 5 shows a bottom view of an embodiment of the first molded thermoplastic member which may be utilized to form an embodiment of the disclosed plant caddy.

Referring now to the Figures, FIG. 1 depicts a top perspective view of an embodiment of the disclosed plant caddy 10. Plant caddy 10 may be configured from a first molded thermoplastic member 100 as depicted in FIGS. 4 and 5. The first molded thermoplastic member 100 is formed with thermoplastic resin in a molding process to have a top planar surface 102 and a bottom surface 104, where the bottom surface may have a plurality of downward facing wheel pedestals 106.

First molded thermoplastic member 100 may also comprise a plurality of pocket members 108, where each of the pocket members may have an upper section 110 which are set with the top planar surface 102 as depicted in FIG. 4. The pocket members 108 of first molded thermoplastic member 100 may each further comprise a lower section 112 set within bottom surface 104. Each pocket member 108 has at least one aperture 114 which extends between the upper section 110 and lower section 112, where each of the apertures 114 are configured to allow a flow of thermoplastic material (i.e., resin) between the upper section and the lower section. Such a flow of thermoplastic material occurs when the matrix material for over-mold members 116 is introduced to the first molded thermoplastic member 100. As indicated in FIGS. 4-5, the plurality of apertures 114 may include both circular apertures and slotted apertures.

Figure 2:
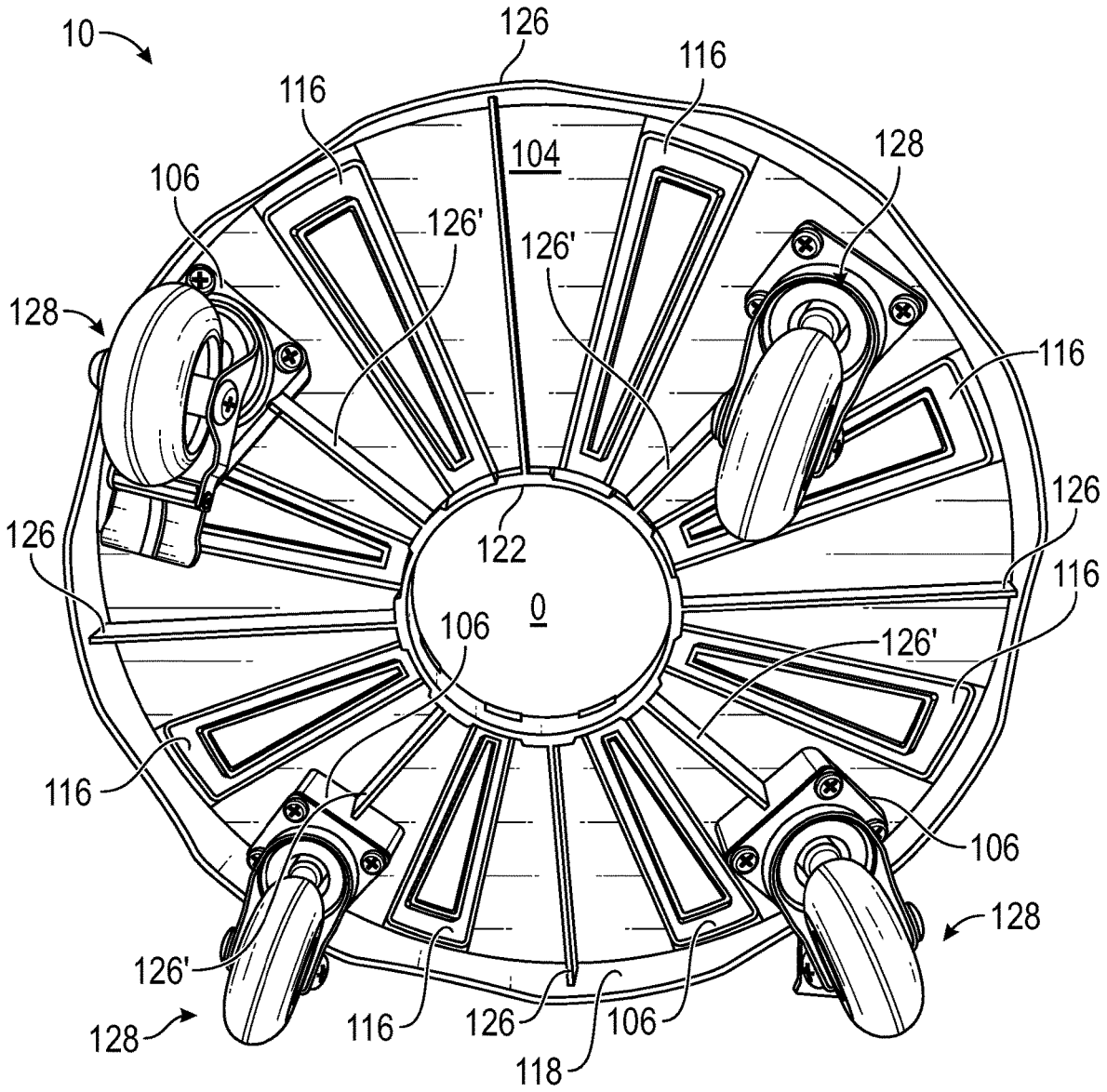
FIG. 2 shows a bottom perspective view of an embodiment of the disclosed plant caddy.

As indicated in FIG. 1, the first molded thermoplastic member 100 may be in a circular configuration having a circular top planar surface which may be bounded by a circumferential edge member 118. Circumferential edge member 118 may be configured such that it extends upwardly from the top circular planar surface 102 thereby defining a circumferential lip member 120 which may be configured such that it encircles and abuts a bottom circumferential surface of a plant container, thereby providing additional support to the plant container when it is moved on the plant caddy 10. As shown in FIG. 2, circumferential edge member 118 may also extend downwardly from a circular bottom surface 104.

As further indicated in FIG. 1, first molded thermoplastic member 100 may further comprise a circular opening O which is defined by a wall member 122. The circular opening O may be concentric with respect to circumferential edge member 118. The circular opening O reduces the weight of the plant caddy 10 and reduces the amount of thermoplastic resin required to produce this embodiment. The circular opening O also provides a drainage path for water draining from the plant container.

As indicated in FIGS. 4-5, pocket members 108 may be configured such that they extend radially between the circular opening O and the circumferential edge member 118. When the pocket members 108 are so configured and provided with a plurality of apertures as shown in FIGS. 4-5, a plurality of over-mold members 116 may be formed as shown in FIGS. 1-2 by following a method of manufacture. In the steps of the method, a heated thermoplastic resin is applied to the first molded thermoplastic member 100 such that the heated resin fills each of the pocket members 108 and flows through apertures 114 resulting in a first portion of the thermoplastic material in the upper section 110 of each pocket member and a second portion of thermoplastic material in the lower section 112 in each pocket member. Upon cooling, the first portion of thermoplastic material in the upper section 110 and the second portion of thermoplastic material in the lower section 112 of the pocket members form a solid and bond to the first molded thermoplastic member thereby forming the plurality of thermoplastic over-mold members 115, with each thermoplastic over-mold member set within a dedicated pocket member 108.

As indicated in FIG. 1, the over-mold members 116 formed by the above process may each have a top surface 124 which extends above top planar surface 102. As discussed above, with this configuration, access below a plant container is provided by the gaps between adjacent over-mold members. These gaps allow water to drain from the plant container and flow through the gaps to either the side of the plant caddy 10 or to the circular opening. 120. In addition, the top surface of the over-mold members which engages the bottom of the plant container may comprise a material which inhibits slippage of the plant container thereby inhibiting sliding or movement of a plant container on the plant caddy 10.

The bottom surface 104 of the first molded thermoplastic member 100 may comprise a plurality of rib members 126. Rib members 126 may extend radially from wall member 122 to the circumferential edge member 118. A pocket member 108 may be disposed between each pair of radially adjacent rib members 126. Some rib members 126' may extend through each of the downwardly facing wheel pedestals 106.

Figure 3:
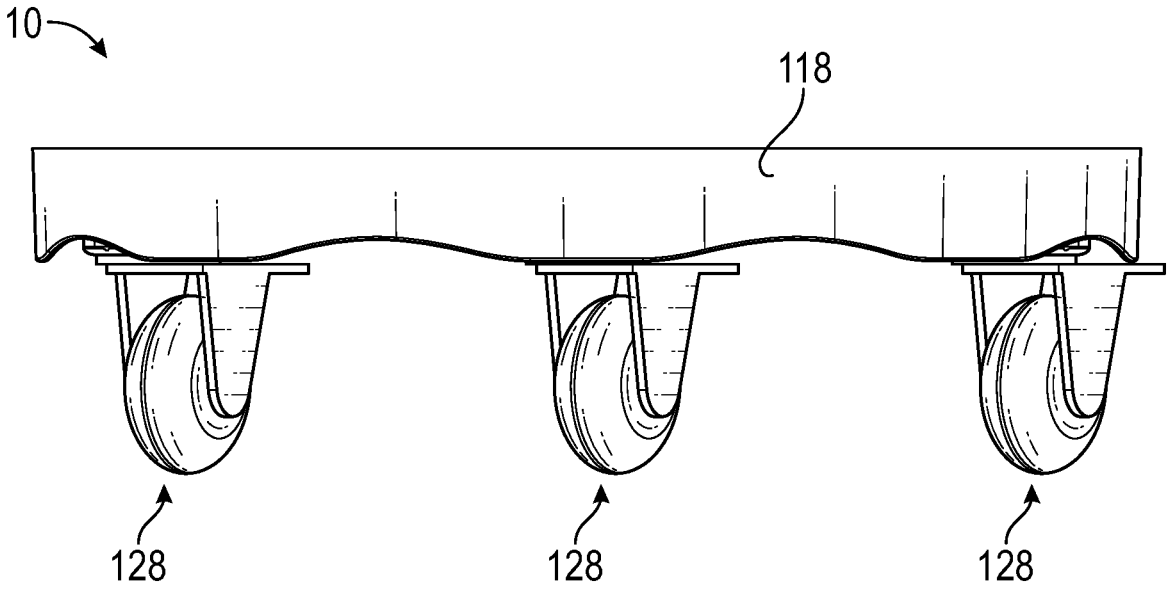
FIG. 3 shows a side view of an embodiment of the disclosed plant caddy.

A wheel assembly (i.e. caster) 128 is affixed to each of the downward facing wheel pedestals 106 such that each wheel assembly is affixed to a dedicated downward facing wheel pedestal as shown in FIGS. 2-3. The wheel assemblies 128 are typically of the type each having a flat bracket which is attachable to each of the plurality of downward facing wheel pedestals with screws or other types of fasteners.

Having thus described the preferred embodiment of the invention, what is claimed as new and desired to be protected by Letters Patent includes the following:

1. A plant caddy comprising:

a first molded thermoplastic member comprising a top planar surface and a bottom surface, wherein the bottom surface comprises a plurality of downward facing wheel pedestals, the first molded thermoplastic member further comprising a plurality of pocket members, each of the pocket members comprising an upper section set within the top planar surface and a lower section set within the bottom surface, each pocket member comprising at least one aperture extending between the upper section and the lower section, each of said apertures configured to allow a flow of a thermoplastic material between the upper section and the lower section;

a plurality of thermoplastic over-mold members, each of said thermoplastic over-mold members having a first portion disposed within the upper section of a dedicated pocket and a second portion disposed within the lower section of the dedicated pocket; and a plurality of wheel assemblies, each wheel assembly attached to a dedicated downward facing wheel pedestal.

2. The plant caddy of claim 1 wherein the first molded thermoplastic member is in a circular configuration and bounded by a circumferential edge member.

3. The plant caddy of claim 2 wherein the first molded thermoplastic member further comprises a circular opening concentric with the circumferential edge member, the circular opening extending through the top planar surface to the bottom surface.

4. The plant caddy of claim 3 wherein each of the pocket members extends radially between the circular opening and the circumferential edge member.

5. The plant caddy of claim 2 wherein the circumferential edge member extends upwardly from the top planar surface thereby defining a circumferential lip member.

6. The plant caddy of claim 5 wherein the circumferential edge member extends downwardly from the bottom surface.

7. The plant caddy of claim 6 wherein the bottom surface comprises a plurality of rib members, each of the rib members extending radially from a wall member adjacent a circular opening to the circumferential edge member.

8. The plant caddy of claim 7 wherein a pocket member is disposed between a pair of radially adjacent rib members.

9. The plant caddy of claim 1 wherein each first portion of the thermoplastic over-mold members comprises a top surface which extends above the top planar surface.

10. A method of manufacturing a plant caddy comprising the following steps:

forming through a molding process a first thermoplastic member, the first thermoplastic member comprising a top planar surface and a bottom surface, wherein the bottom surface comprises a plurality of downward facing wheel pedestals, the first thermoplastic member further comprising a plurality of pocket members, each of the pocket members comprising at least one aperture extending between the top planar surface and the bottom surface;

allowing the first thermoplastic member to cool;

applying a heated thermoplastic resin to the first thermoplastic member, the heated thermoplastic resin filling each of the plurality of pocket members and flowing through the apertures of each pocket member resulting in a first portion of the heated thermoplastic resin on the top planar surface and a second portion of the second heated thermoplastic resin on the bottom surface;

allowing the second heated thermoplastic resin to cool to a solid resulting in a plurality of thermoplastic over-mold members, each disposed within a pocket member, the thermoplastic over-mold members bonded with the first thermoplastic member; and affixing a wheel assembly to each of the downward facing wheel pedestals.

11. The method of claim 10 wherein the first thermoplastic member is in a circular configuration and bounded by a circumferential edge member.

12. The method of claim 11 wherein the first thermoplastic member further comprises a circular opening concentric with the circumferential edge member, the circular opening extending through the top planar surface to the bottom surface.

13. The method of claim 12 wherein each of the pocket members extends radially between the circular opening and the circumferential edge member.

14. The method of claim 13 wherein the circumferential edge member extends upwardly from the top planar surface thereby defining a circumferential lip member.

15. The method of claim 14 wherein the circumferential edge member extends downwardly from the bottom surface.

16. The method of claim 13 wherein the bottom surface comprises a plurality of rib members, each of the rib members extending radially from a wall member adjacent the circular opening to the circumferential edge member.

17. The method of claim 16 wherein a pocket member is disposed between a pair of radially adjacent rib members.

18. The method of claim 16 wherein a rib member of the plurality of rib members extends through each of the downward facing wheel pedestals.

19. A plant caddy comprising:

a first molded thermoplastic member comprising a circular top planar surface and a circular bottom surface, wherein the first molded thermoplastic member is bounded by a circumferential edge member, wherein the first molded thermoplastic member further comprises a circular opening concentric with the circumferential edge member, the circular opening extending through the top planar surface to the bottom surface, wherein the bottom surface comprises a plurality of downward facing wheel pedestals, the first molded thermoplastic member further comprising a plurality of pocket members, each of the pocket members comprising an upper section set within the top planar surface and a lower section set within the bottom surface;

a plurality of thermoplastic over-mold members, each of said thermoplastic over-mold members having a first portion disposed within the upper section of a dedicated pocket member and a second portion disposed within the lower section of the dedicated pocket member, wherein each of the first portions has a top surface which extends above the top planar surface; and a plurality of wheel assembles, each wheel assembly attached to a dedicated downward facing wheel pedestal.

20. The plant caddy of claim 19 wherein each of the pocket members extends radially between the concentric circular opening and the circumferential edge member.

* * * * *